US010876723B2

(12) United States Patent
Yang et al.

(10) Patent No.: US 10,876,723 B2
(45) Date of Patent: Dec. 29, 2020

(54) LIGHTING APPARATUS

(71) Applicant: XIAMEN ECO LIGHTING CO. LTD., Xiamen (CN)

(72) Inventors: Yi Yang, Xiamen (CN); Liangliang Cao, Xiamen (CN); Lilei Su, Xiamen (CN); Mingyan Fu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 139 days.

(21) Appl. No.: 16/042,514

(22) Filed: Jul. 23, 2018

(65) Prior Publication Data

US 2019/0376677 A1 Dec. 12, 2019

(30) Foreign Application Priority Data

Jun. 8, 2018 (CN) ..... 2018 2 0891411 U

(51) Int. Cl.

| | |
|---|---|
| ***F21V 29/70*** | (2015.01) |
| ***F21V 23/06*** | (2006.01) |
| ***F21V 23/00*** | (2015.01) |
| *F21Y 115/10* | (2016.01) |

(52) U.S. Cl.

CPC ..... *F21V 23/06* (2013.01); *F21V 23/003* (2013.01); *F21V 29/70* (2015.01); *F21Y 2115/10* (2016.08)

(58) Field of Classification Search

CPC .. F21V 29/70; F21Y 2107/30; F21Y 2107/40; F21K 9/232

See application file for complete search history.

(56) References Cited

U.S. PATENT DOCUMENTS

2011/0069500 A1* 3/2011 Meyer, IV ..... F21V 29/20 362/373

* cited by examiner

*Primary Examiner* — Sean P Gramling

(74) *Attorney, Agent, or Firm* — Chun-Ming Shih; Lanway IPR Services

(57) ABSTRACT

A lighting apparatus has a heat sink sleeve module, a light support module, a driver and two terminals. The heat sink sleeve module defines a containing space and has a first inner surface and a second inner surface. The light support module disposed at least partly in the containing space. The light support module having a top plate, a first side plate and a second side plate. The top plate is mounted with a LED module. The first side plate and the second side plate are respectively appressed to the first inner surface and the second inner surface.

16 Claims, 6 Drawing Sheets

LIGHTING APPARATUS

FIELD OF INVENTION

The present invention is related to a lighting apparatus and more particularly related to a module style lighting apparatus.

BACKGROUND

LED technology is developing rapidly in recent years. More and more lighting devices are installed with LED modules.

LED modules have some features not found in the past and thus, there are various challenges and potential advantages to be discovered by finding technical problems, unexpected results and by figuring out innovative designs to achieve more technical benefits.

Installation is one important factor when designing lighting devices. With easier installation structure, it is more convenient for users to use LED lighting devices and brings better human life quality.

In addition, manufacturing cost and difficulty are necessary to be considered too for further promoting products to be used around the world. In the crowded field of LED lighting devices, any improvement may bring huge influence and great benefit for more people.

SUMMARY OF INVENTION

According to an embodiment of the present invention, a lighting apparatus includes a heat sink sleeve module, a light support module, a driver and two terminals.

The heat sink sleeve module comprising heat conductive material. For example, the heat sink sleeve module may be made of metal or plastic material with nice heat conductive characteristic.

The heat sink sleeve defines a containing space and has a first inner surface and a second inner surface. For example, the heat sink sleeve module may have a general tube shape and has two inner surfaces in its inner walls.

The light support module is disposed at least partly in the containing space. In other words, the light support module may be complete located in the containing space of the heat sink sleeve module or partly located in the containing space of the heat sink sleeve module.

The light support module has a top plate, a first side plate and a second side plate. The top plate is mounted with a LED module. The LED module may have one or more than one LED chips located close to each other or may have several parts located diversely on the top plate of the light support module.

The first side plate and the second side plate are respectively appressed to the first inner surface and the second inner surface of the top plate. With such design, heat may be easily transmitted from the first side plate and the second side plate to the heat sink sleeve module.

The first side plate and the second side plate are opposite to each other.

The driver is attached to the light support module. The driver may contain one or multiple electrical components and related wires.

The two terminals are used for guiding an external power source to the driver for the driver to generate a driving current to the LED module.

The lighting apparatus may be further coupled to a socket for getting the external power source.

In some embodiments, the light support module may include a base plate. The base plate is folded to form the top plate, the first side plate and the second side plate. For example, the base plate may be a foldable elongated sheet with two folded parts into a U shape structure defined by the top plate, the first side plate and the second side plate. The base plate may have more folded parts, like the examples explained as follows.

In some embodiments, the base plate is made of flexible material so as to be folded at predetermined positions. In some examples, the base plate is a metal sheet and may be folded at specific folded parts. In some other examples, the base plate may be a flexible circuit board, and the folded parts may have certain curve angle, instead of 90 degrees folding style.

In some embodiments, the inner sides of the first side plate and the second side plate are fixed with heat conductive elements. In other words, one side of the first side plate is appressed to first inner surface of the heat sink sleeve module and the other side of the first side plate is attached with the heat conductive elements.

In some embodiments, the heat conductive elements are heat conductive plates transmitting heat to the heat sink sleeve module via the first side plate and the second side plate. For example, the base plate may be a think sheet while aluminum or other metal plates are used as the heat conductive elements. A complete plate with various shapes may be used while other alternative structures may be used, too.

For example, fins, concave, convex structures may be used. Net structures may be used for decreasing material cost while increasing heat conductivity.

In some embodiments, the heat conductive plates have a greater hardness than the base plate. Specifically, the heat conductive plates or other heat conductive elements may be difficult to be folded, compared with the base plate of the light support module. In addition, the base plate may be thinner than the heat conductive elements.

In some embodiments, the heat sink sleeve module may have a top entrance for inserting the light support module into the containing space. The LED module is out of the containing space for emitting light outwardly.

In some embodiments, there is further a light shell fixed to the heat sink sleeve module for covering the LED module while allowing the light to exit via the light shell. The light shell may be used for protecting the LED module. In addition, the light shell may be transparent or translucent, depending on different requirements. Colors may also be adjusted by using different filter materials. Lens may also be used for different design needs.

In some embodiments, the heat sink sleeve module has a top shrinking part for the light shell to plug onto so that after the light shell is placed on the top shrinking part, an external surface of the light shell is continuous to an external surface of the heat sink sleeve module. In other words, the light shell may be plugged into the corresponding groove so that the overall external surface of the light shell and the heat sink sleeve module may be a continuous surface.

In some embodiments, the light shell and the heat sink sleeve module together form a box style housing for containing the light support module. Please be noted that the box style does not need to be 90 degrees between adjacent surfaces. The box style refers to a rectangular tube with one opening for exposing the LED module while the other opening for exposing the two terminals to be connected to external power source.

In some embodiments, the two terminals are exposed outside the box style housing for coupling to a corresponding socket. The socket may be a standard socket like Edison sockets or other customized sockets.

In some embodiments, the heat sink sleeve module has a tunnel for the light support module to move into the containing space via the top entrance. The ends of the two terminals may be elastic and have a larger raw span than a width of the tunnel. The ends of the two terminals are expanded back to the larger raw span after the light support module is installed in the containing space. The ends of the two terminals are hooked by hook structures of the heat sink sleeve module.

In other words, the two terminals may change their span during passing the tunnel and recovers to their raw span so that unless an external force is applied, the two terminals help the light support module to avoid re-enter the tunnel, thus structurally fix the light support module to the heat sink sleeve module.

In some embodiments, the heat sink sleeve module has a plug unit with the hook structures. The plug unit is designed to be plugged into the corresponding socket for fixing the heat sink sleeve module to the corresponding socket. In other words, the plug unit is plugged into a corresponding socket. The two terminals are fixed to the plug unit and also plugged into the corresponding socket to get the external power source, e.g. 110V or 220V power source. Battery may also be an external power source mentioned here. The plug unit helps position the two terminals to connect to corresponding metal conductive elements.

In some embodiments, the heat sink sleeve module may have a guiding groove for guiding the light support module moving in the tunnel. The heat conductive elements are attached on the inner side of the base plate, as mentioned above, and may form a structure convex structure so as to match the guiding groove to ensure the light support module to easily slide with respect to the guiding groove.

In some embodiments, the driver is fixed to the base plate. Heat generated by the driver is also transmitted to the heat sink sleeve module via the base plate.

In some embodiments, a driver plate part of the base plate is used for mounting the driver and the driver plate part is folded with respect to other part of the base plate to locate the driver inside the light support module. In other words, if the base plate is an elongated sheet, the driver is also mounted directly on the elongated sheet. The elongated sheet is folded so as to locate the driver to stay between the first side plate and the second side plate.

In some embodiments, the two terminals are two metal pins for providing structure connection between the light support module and the heat sink sleeve module.

In some embodiments, the lighting apparatus of claim 1, the light support module may be a U shape structure defined by the top plate, the first side plate and the second side plate.

In some embodiments, the light support module may have an elastic force to be closely appressed to the first inner surface and the second inner surface of the heat sink sleeve module.

In some embodiments, heat dissipation glue may be applied between the heat sink sleeve module and the light support module.

In some embodiments, the first plate and the second plate have elastic protruding structures to be closed appressed to the first inner surface and the second inner surface respectively.

The features mentioned above may be partly or completely be used in different embodiments according to the present invention.

DETAILED DESCRIPTION

Please refer to FIG. 1 to FIG. 5, which illustrates an embodiment of a lighting apparatus.

Figure 1:
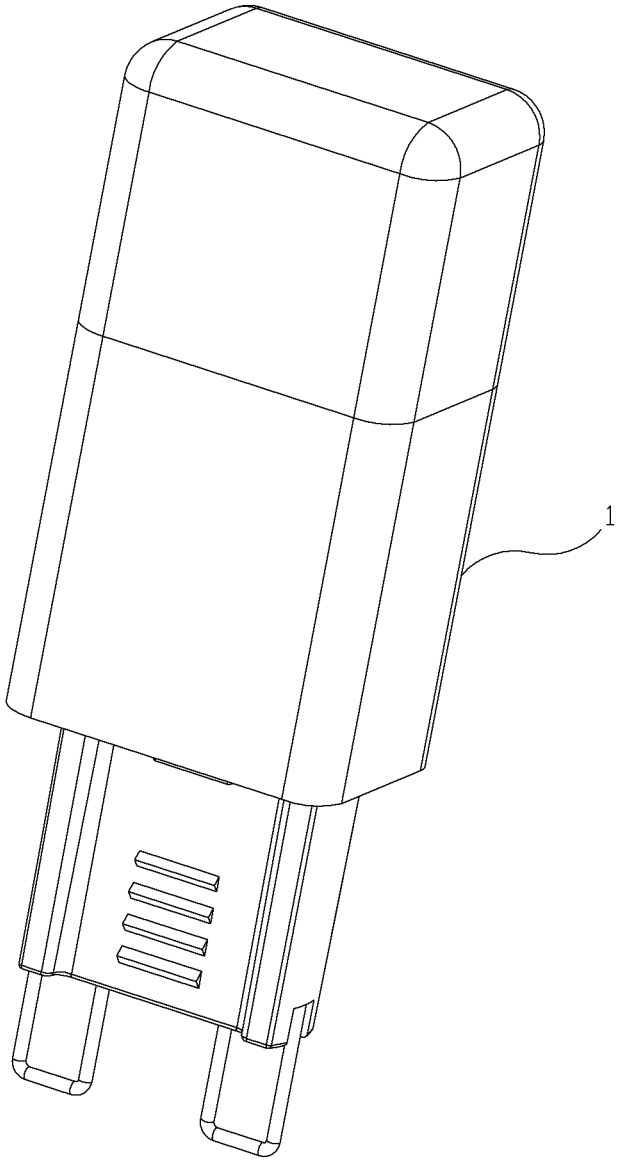
FIG. 1 illustrates a perspective view of a lighting apparatus embodiment.

FIG. 1 illustrates a perspective view of a lighting apparatus embodiment. In FIG. 1, a box style lighting apparatus is illustrated. The lighting apparatus has a heat sink sleeve module 1, which may be made of metal that helps dissipates heat of its LED module and driver. The lighting apparatus has a plug at its bottom part and a light shell at its top part.

Figure 2:
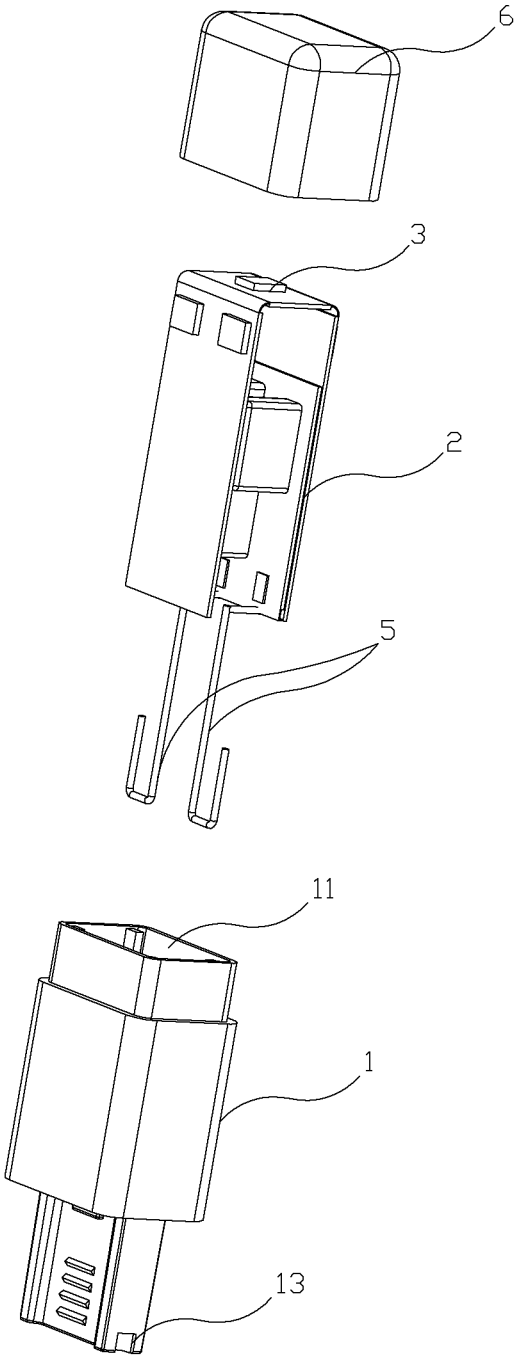
FIG. 2 illustrates an exploded view of the embodiment of FIG. 1.

FIG. 2 illustrates an exploded view of the embodiment of FIG. 1. In FIG. 2, a light shell 6 may be transparent or translucent so that light from a LED module 3 may be emitted via the light shell 6. The LED module 3 is mounted on a top plate of a light support module 2. The light support module 2 is connected to two terminals 5 that provide structural support and electrical connection to an external power source.

The light support module 2 has a first side plate and a second side plate that are appressed to an first inner surface 11 and a second inner surface of the heat sink sleeve module 1. The heat sink sleeve module 1 further has a plug unit 13 to be plugged into a corresponding socket. The two terminals 5 are fixed to the plug unit 13. Ends of the two terminals 5 are hooked by two hook structures at ends of the plug unit 13.

Figure 3:
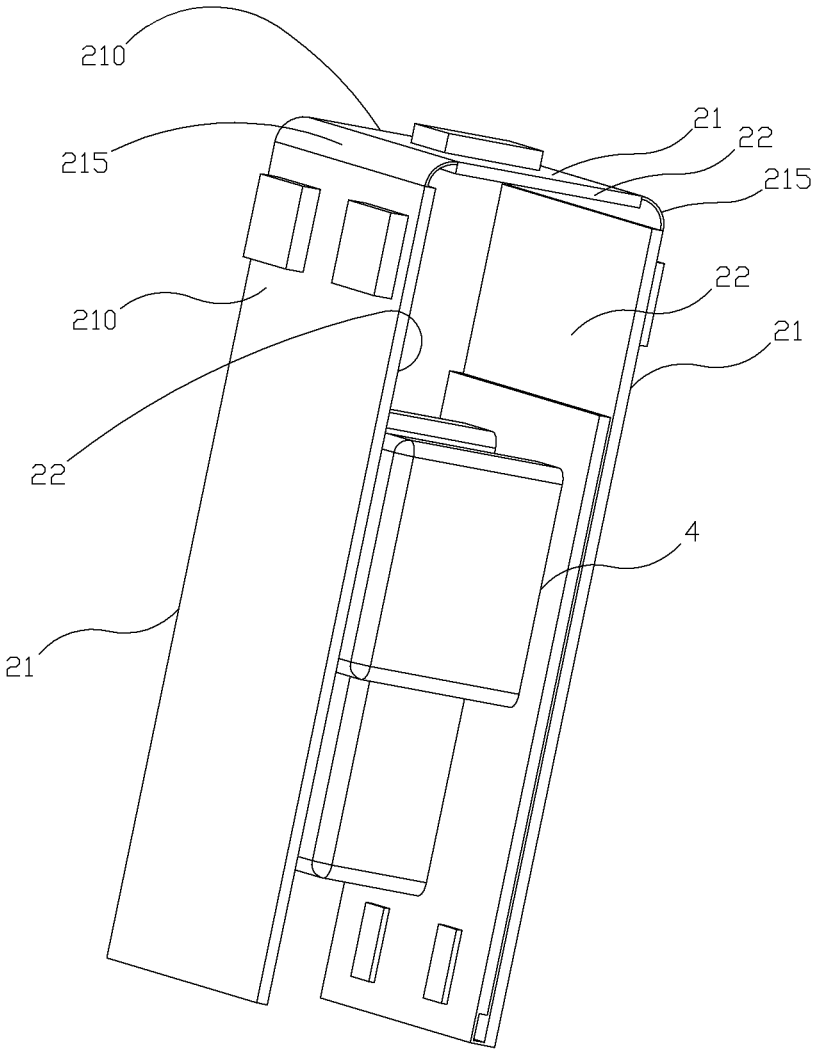
FIG. 3 illustrates an example of a light support module of the embodiment of FIG. 1.

FIG. 3 illustrates an example of a light support module of the embodiment of FIG. 1. In FIG. 3, it is illustrated the light support module has a base plate 21. The base plate 21 has a top plate that has a heat conductive plate 22 in its inner side. The first side plate and the second side plate also have heat conductive plates 22 in their inner side.

The external surface 210 is facing to the heat sink sleeve module. The base plate 21 is also mounted with a driver 4. The driver 4 is contained between the first side plate and the second side plate. The base plate is folded at folded parts 215 forming a U style structure.

Figure 4:
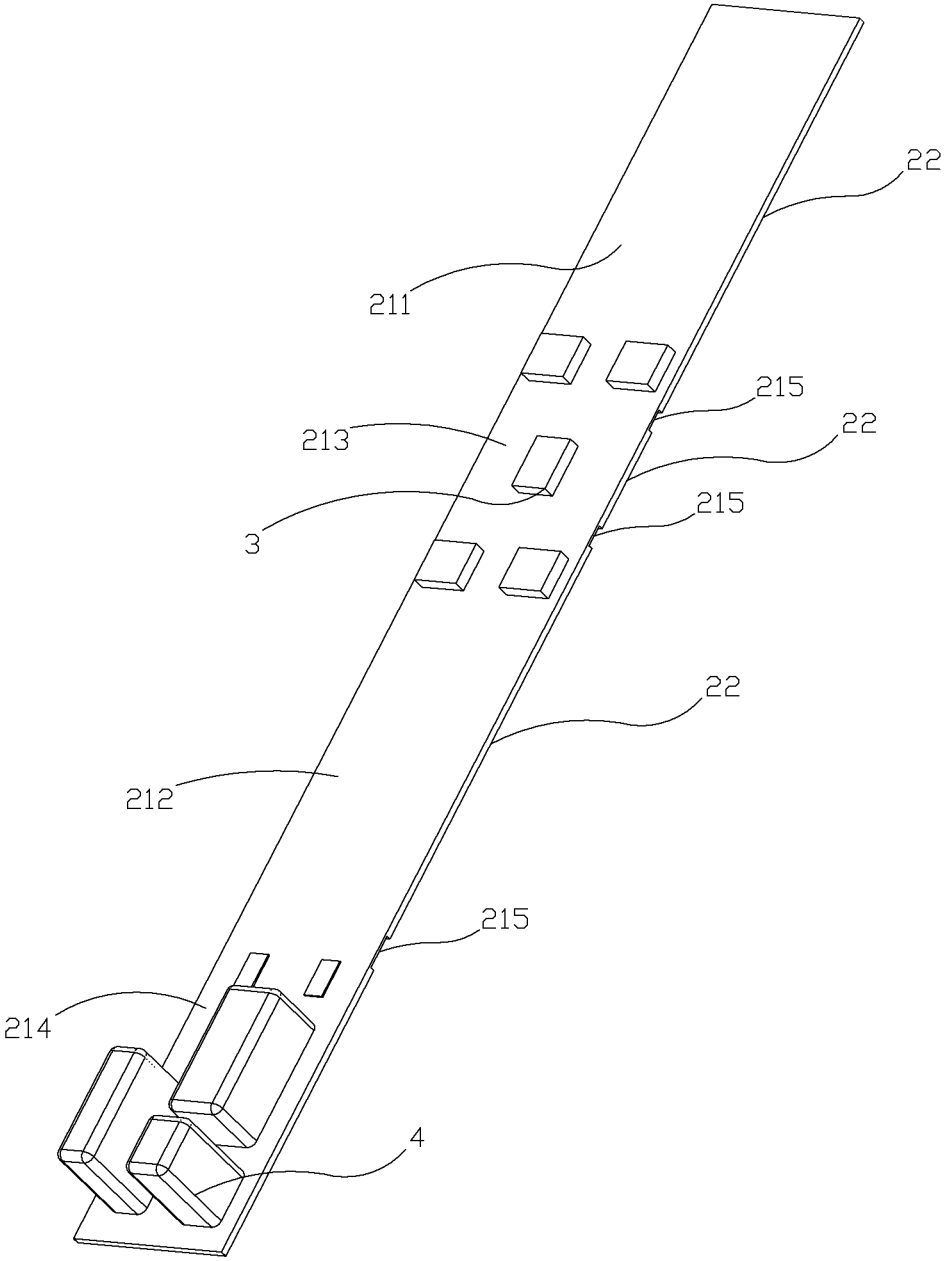
FIG. 4 illustrates a base plate before being folded to the form used in the embodiment of FIG. 1.

FIG. 4 illustrates a base plate before being folded to the form used in the embodiment of FIG. 1. In FIG. 4, it is shown that before being folded, the base plate 22 is an elongated sheet that has a top plate part 213, a first side plate part 211 and a second side plate part 212. The base plate 22 is folded at folded parts 215 to form the structure illustrated in FIG. 3.

Figure 5:
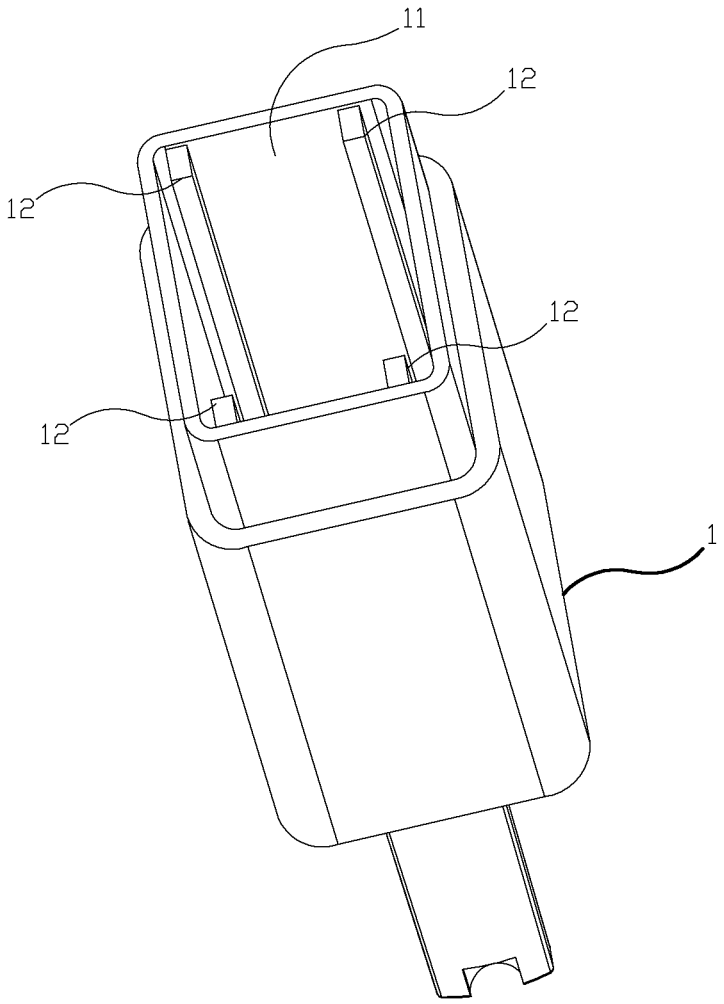
FIG. 5 shows another view of the embodiment of FIG. 1.

FIG. 5 shows another view of the embodiment of FIG. 1. In FIG. 5, several guiding grooves 12 are illustrated for guiding the light support module to slide into the tunnel, the hollow opening, of the heat sink sleeve module 1.

According to an embodiment of the present invention, a lighting apparatus includes a heat sink sleeve module, a light support module, a driver and two terminals.

The heat sink sleeve module comprising heat conductive material. For example, the heat sink sleeve module may be made of metal or plastic material with nice heat conductive characteristic.

The heat sink sleeve defines a containing space and has a first inner surface and a second inner surface. For example, the heat sink sleeve module may have a general tube shape and has two inner surfaces in its inner walls.

The light support module is disposed at least partly in the containing space. In other words, the light support module may be complete located in the containing space of the heat sink sleeve module or partly located in the containing space of the heat sink sleeve module.

The light support module has a top plate, a first side plate and a second side plate. The top plate is mounted with a LED module. The LED module may have one or more than one LED chips located close to each other or may have several parts located diversely on the top plate of the light support module.

The first side plate and the second side plate are respectively appressed to the first inner surface and the second inner surface of the top plate. With such design, heat may be easily transmitted from the first side plate and the second side plate to the heat sink sleeve module. The first side plate and the second side plate are opposite to each other.

The driver is attached to the light support module. The driver may contain one or multiple electrical components and related wires.

The two terminals are used for guiding an external power source to the driver for the driver to generate a driving current to the LED module.

The lighting apparatus may be further coupled to a socket for getting the external power source.

In some embodiments, the light support module may include a base plate. The base plate is folded to form the top plate, the first side plate and the second side plate. For example, the base plate may be a foldable elongated sheet with two folded parts into a U shape structure defined by the top plate, the first side plate and the second side plate. The base plate may have more folded parts, like the examples explained as follows.

In some embodiments, the base plate is made of flexible material so as to be folded at predetermined positions. In some examples, the base plate is a metal sheet and may be folded at specific folded parts. In some other examples, the base plate may be a flexible circuit board, and the folded parts may have certain curve angle, instead of 90 degrees folding style.

In some embodiments, the inner sides of the first side plate and the second side plate are fixed with heat conductive elements. In other words, one side of the first side plate is appressed to first inner surface of the heat sink sleeve module and the other side of the first side plate is attached with the heat conductive elements.

In some embodiments, the heat conductive elements are heat conductive plates transmitting heat to the heat sink sleeve module via the first side plate and the second side plate. For example, the base plate may be a think sheet while aluminum or other metal plates are used as the heat conductive elements. A complete plate with various shapes may be used while other alternative structures may be used, too.

For example, fins, concave, convex structures may be used. Net structures may be used for decreasing material cost while increasing heat conductivity.

In some embodiments, the heat conductive plates have a greater hardness than the base plate. Specifically, the heat conductive plates or other heat conductive elements may be difficult to be folded, compared with the base plate of the light support module. In addition, the base plate may be thinner than the heat conductive elements.

In some embodiments, the heat sink sleeve module may have a top entrance for inserting the light support module into the containing space. The LED module is out of the containing space for emitting light outwardly.

In some embodiments, there is further a light shell fixed to the heat sink sleeve module for covering the LED module while allowing the light to exit via the light shell. The light shell may be used for protecting the LED module. In addition, the light shell may be transparent or translucent, depending on different requirements. Colors may also be adjusted by using different filter materials. Lens may also be used for different design needs.

In some embodiments, the heat sink sleeve module has a top shrinking part for the light shell to plug onto so that after the light shell is placed on the top shrinking part, an external surface of the light shell is continuous to an external surface of the heat sink sleeve module. In other words, the light shell may be plugged into the corresponding groove so that the overall external surface of the light shell and the heat sink sleeve module may be a continuous surface.

In some embodiments, the light shell and the heat sink sleeve module together form a box style housing for containing the light support module. Please be noted that the box style does not need to be 90 degrees between adjacent surfaces. The box style refers to a rectangular tube with one opening for exposing the LED module while the other opening for exposing the two terminals to be connected to external power source.

In some embodiments, the two terminals are exposed outside the box style housing for coupling to a corresponding socket. The socket may be a standard socket like Edison sockets or other customized sockets.

In some embodiments, the heat sink sleeve module has a tunnel for the light support module to move into the containing space via the top entrance. The ends of the two terminals may be elastic and have a larger raw span than a width of the tunnel. The ends of the two terminals are expanded back to the larger raw span after the light support module is installed in the containing space. The ends of the two terminals are hooked by hook structures of the heat sink sleeve module.

In other words, the two terminals may change their span during passing the tunnel and recovers to their raw span so that unless an external force is applied, the two terminals help the light support module to avoid re-enter the tunnel, thus structurally fix the light support module to the heat sink sleeve module.

In some embodiments, the heat sink sleeve module has a plug unit with the hook structures. The plug unit is designed to be plugged into the corresponding socket for fixing the heat sink sleeve module to the corresponding socket. In other words, the plug unit is plugged into a corresponding socket. The two terminals are fixed to the plug unit and also plugged into the corresponding socket to get the external power source, e.g. 110V or 220V power source. Battery may also be an external power source mentioned here. The plug unit helps position the two terminals to connect to corresponding metal conductive elements.

In some embodiments, the heat sink sleeve module may have a guiding groove for guiding the light support module moving in the tunnel. The heat conductive elements are attached on the inner side of the base plate, as mentioned above, and may form a structure convex structure so as to match the guiding groove to ensure the light support module to easily slide with respect to the guiding groove.

In some embodiments, the driver is fixed to the base plate. Heat generated by the driver is also transmitted to the heat sink sleeve module via the base plate.

In some embodiments, a driver plate part of the base plate is used for mounting the driver and the driver plate part is folded with respect to other part of the base plate to locate the driver inside the light support module. In other words, if the base plate is an elongated sheet, the driver is also mounted directly on the elongated sheet. The elongated sheet is folded so as to locate the driver to stay between the first side plate and the second side plate.

In some embodiments, the two terminals are two metal pins for providing structure connection between the light support module and the heat sink sleeve module.

In some embodiments, the light support module may be a U shape structure defined by the top plate, the first side plate and the second side plate.

In some embodiments, the light support module may have an elastic force to be closely appressed to the first inner surface and the second inner surface of the heat sink sleeve module.

In some embodiments, heat dissipation glue may be applied between the heat sink sleeve module and the light support module.

In some embodiments, the first plate and the second plate has elastic protruding structures to be closed appressed to the first inner surface and the second inner surface respectively.

Figure 6A:
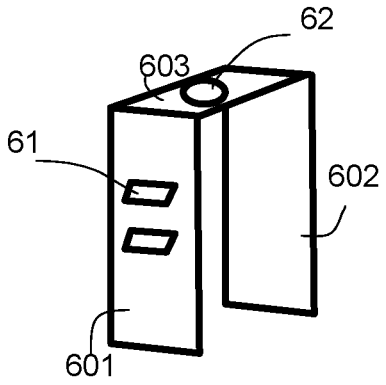
FIG. 6A illustrates a first example of a base plate.

FIG. 6A illustrates a first example of a base plate. In FIG. 6A, a base plate has a top plate 603, a first side plate 601 and a second side plate 602. A LED module 62 is mounted on the top plate 603. On external surface of the first side plate 601, several protruding structures 61 may be placed to enhance connection between the light support module and the heat sink sleeve module.

Figure 6B:
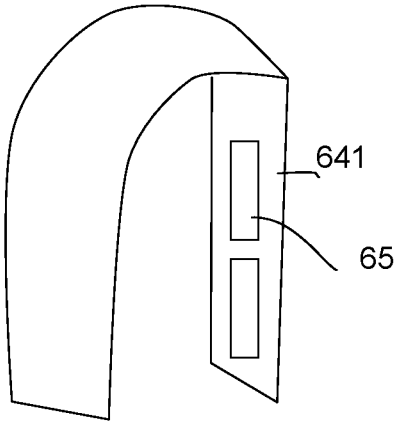
FIG. 6B illustrates another example of a base plate.

FIG. 6B illustrates another example of a base plate. Unlike FIG. 6A, the base plate in FIG. 6B is more flexible and the folded part may not have a folded angle of 90 degrees. Instead, there may be some curve angle between the first side plate 641 and its top plate. The heat conductive plate 65 attached to inner side of the first side plate 641 may have larger thickness and hardness than the first side plate 641.

The features mentioned above may be partly or completely be used in different embodiments according to the present invention.

In addition to the above-described embodiments, various modifications may be made, and as long as it is within the spirit of the same invention, the various designs that can be made by those skilled in the art are belong to the scope of the present invention.

The invention claimed is:

1. A lighting apparatus, comprising:

a heat sink sleeve module comprising heat conductive material, the heat sink sleeve module defining a containing space and having a first inner surface and a second inner surface;

a light support module disposed at least partly in the containing space, the light support module having a top plate, a first side plate and a second side plate, the top plate being mounted with a LED module, the first side plate and the second side plate being respectively appressed to the first inner surface and the second inner surface of the heat sink sleeve module, the first side plate and the second side plate being opposite to each other;

a driver attached to the light support module; and two terminals for guiding an external power source to the driver for the driver to generate a driving current to the LED module, wherein the light support module comprises a base plate, the base plate is folded to form the top plate, the first side plate and the second side plate, wherein inner sides of the first side plate and the second side plate are fixed with heat conductive elements, wherein the heat conductive elements are heat conductive plates transmitting heat to the heat sink sleeve module via the first side plate and the second side plate, wherein the heat conductive plates have a greater hardness than the base plate.

2. The lighting apparatus of claim 1, wherein the base plate is made of flexible material.

3. The lighting apparatus of claim 1, wherein the heat sink sleeve module has a top entrance for inserting the light support module into the containing space, the LED module is placed out of the containing space for emitting light outwardly.

4. The lighting apparatus of claim 3, further comprising a light shell fixed to the heat sink sleeve module for covering the LED module while allowing the light to exit via the light shell.

5. The lighting apparatus of claim 4, wherein the heat sink sleeve module has a top shrinking part for the light shell to plug onto so that after the light shell is placed on the top shrinking part, an external surface of the light shell is continuous to an external surface of the heat sink sleeve module.

6. The lighting apparatus of claim 4, wherein the light shell and the heat sink sleeve module together form a box style housing for containing the light support module, the two terminals are exposed outside the box style housing for coupling to a corresponding socket.

7. The lighting apparatus of claim 6, wherein the heat sink sleeve module has a tunnel for the light support module to move into the containing space via the top entrance, ends of the two terminals are elastic and have a larger raw span than a width of the tunnel, the ends of the two terminals are expanded back to the larger raw span after the light support module is installed in the containing space, and the ends of the two terminals are hooked by hook structures of the heat sink sleeve module.

8. The lighting apparatus of claim 7, wherein the heat sink sleeve module has a plug unit with the hook structures, the plug unit is designed to be plugged into the corresponding socket for fixing the heat sink sleeve module to the corresponding socket.

9. The lighting apparatus of claim 6, wherein the heat sink sleeve module has a guiding groove for guiding the light support module moving in a tunnel.

10. The lighting apparatus of claim 1, wherein the driver is fixed to the base plate, heat generated by the driver is transmitted to the heat sink sleeve module via the base plate.

11. The lighting apparatus of claim 8, wherein a driver plate part of the base plate is used for mounting the driver and the driver plate part is folded with respect to other part of the base plate to locate the driver inside the light support module.

12. The lighting apparatus of claim 1, wherein the two terminals are two metal pins for providing structure connection between the light support module and the heat sink sleeve module.

13. The lighting apparatus of claim 1, wherein the light support module is a U shape structure defined by the top plate, the first side plate and the second side plate.

14. The lighting apparatus of claim 1, wherein the light support module has an elastic force to be closely appressed to the first inner surface and the second inner surface of the heat sink sleeve module.

15. The lighting apparatus of claim 1, wherein heat dissipation glue is applied between the heat sink sleeve module and the light support module.

16. The lighting apparatus of claim 1, wherein the first plate and the second plate have elastic protruding structures to be closed appressed to the first inner surface and the second inner surface respectively.

* * * * *